US008870493B2

(12) United States Patent
Haire

(10) Patent No.: US 8,870,493 B2
(45) Date of Patent: Oct. 28, 2014

(54) CULVERT GATE ASSEMBLY

(71) Applicant: Steve Haire, Kent, MN (US)

(72) Inventor: Steve Haire, Kent, MN (US)

(73) Assignee: Machine Design, Inc., Wahpeton, ND (US)

( * ) Notice: Subject to any disclaimer, the term of this patent is extended or adjusted under 35 U.S.C. 154(b) by 0 days.

(21) Appl. No.: 13/897,564

(22) Filed: May 20, 2013

(65) Prior Publication Data

US 2013/0315670 A1 Nov. 28, 2013

Related U.S. Application Data

(60) Provisional application No. 61/651,923, filed on May 25, 2012.

(51) Int. Cl.

| | |
|---|---|
| ***E02B 5/08*** | (2006.01) |
| ***E01F 5/00*** | (2006.01) |
| ***F16K 15/03*** | (2006.01) |
| ***E02B 13/02*** | (2006.01) |
| ***E02B 7/20*** | (2006.01) |

(52) U.S. Cl.

CPC . *E02B 7/20* (2013.01); *E02B 13/02* (2013.01); *E01F 5/005* (2013.01); *E02B 5/08* (2013.01)

USPC ..... 405/125; 405/94; 405/100; 137/527.6

(58) Field of Classification Search

USPC ..... 405/90, 94, 99, 100, 124, 125, 127; 137/527.6

See application file for complete search history.

(56) References Cited

U.S. PATENT DOCUMENTS

| | | | | |
|---|---|---|---|---|
| 929,514 | A * | 7/1909 | Tenold | 137/527.6 |
| 1,670,519 | A * | 5/1928 | Pekrul | 405/100 |
| 1,837,658 | A * | 12/1931 | Force et al. | 137/527.6 |
| 1,929,527 | A * | 10/1933 | Treverton | 137/527.6 |
| 2,961,836 | A * | 11/1960 | Hanson et al. | 405/99 |
| 3,941,151 | A * | 3/1976 | Biddle | 137/527.6 |
| 4,324,506 | A | 4/1982 | Steinke | |
| 4,495,859 | A * | 1/1985 | Janke et al. | 137/527.6 |
| 4,800,919 | A | 1/1989 | Bachmann | |
| 4,942,898 | A * | 7/1990 | Osowski | 405/124 |
| 5,327,933 | A * | 7/1994 | Ishikawa et al. | 137/527.6 |
| 6,474,365 | B1 * | 11/2002 | Brown et al. | 137/527.6 |
| 8,459,298 | B1 * | 6/2013 | Valdez et al. | 137/527.6 |

* cited by examiner

*Primary Examiner* — Frederick L Lagman

(74) *Attorney, Agent, or Firm* — Vidas, Arrett & Steinkraus, P.A.

(57) ABSTRACT

A gate assembly for use on a pipe, such as a culvert pipe. The assembly having an adjustable engagement band defining an opening. The opening having a nominal diameter sized to engage a culvert pipe. The diameter of the opening being adjustable by up to plus or minus 30 percent the nominal diameter.

13 Claims, 16 Drawing Sheets

CULVERT GATE ASSEMBLY

CROSS REFERENCE TO RELATED APPLICATIONS

This Application claims priority to U.S. Provisional Application No. 61/651,923, filed May 25, 2012, the entire contents of which are herein incorporated by reference.

TECHNICAL FIELD

This disclosure relates to a water management gate assembly for use at one or more ends of a culvert pipe or other tubular water management structure. More specifically, the disclosure describes a unique flap gate assembly, its manufacture and use.

BACKGROUND

Culvert pipes are well-known and are commonly employed as a conduit for water drainage and management. Culverts are constructed of metal, concrete or polymer and may be formed into a variety of cross-sectional shapes. Culverts are typically placed at or under ground such as under bridges, roadways, etc. to allow water to pass through the culvert pipe from one side of the overlying structure to the other. Often it is desirable to allow water to more readily pass in a single direction through the culvert pipe. In such instances a flap gate can be installed at one or more ends of the culvert pipe.

An example of a known type of flap gate is described in U.S. Pat. No. 4,324,506, which issued Apr. 13, 1982 to Thomas J. Steinke. Another type of flap gate is described in U.S. Pat. No. 4,800,919, which issued Jan. 31, 1989 to Lothar Bachman. The entire content of each of the aforementioned patents is incorporated herein by reference.

One problem that exists in many known flap gate assemblies is that they are prefabricated to be mounted to a specific diameter culvert pipe. Often if the end of the pipe to which the assembly is to be mounted is misshaped, damaged or otherwise outside the acceptable mounting criteria it can be difficult or impossible to properly mount the flap gate assembly thereto. Given the often hard to reach locations of culvert pipes and the relatively cumbersome size and shape of most flap gates assemblies, correctively machining the assembly or pipe on site to correct the fit is often problematic or impossible. In addition, many known gate assemblies require multiple people (installers) to properly affix an assembly to a culvert pipe.

In light of the above, a need exists to provide an adjustable culvert gate assembly which has a greater tolerance of imperfect pipe mounting shapes/surfaces and diameters than known prefabricate gate assemblies, and which can be more readily mounted by a single installer.

SUMMARY

In general, this disclosure describes a culvert gate assembly which includes a new clamping mechanism which allows the assembly to be more easily fitted to imperfectly sized or shaped culvert pipes of an intended diameter. More specifically, the gate assembly described herein includes a "quick clamp" mechanism which not only allows the gate band to be more easily affixed to a culvert pipe with only a single installer, but also provides redundant securement of the support band and lid to the culvert pipe to which the gate assembly is attached.

The details of one or more aspects of the disclosure are set forth in the accompanying drawings and the description below. Other features, objects, and advantages will be apparent from the description and drawings, and from the claims.

DETAILED DESCRIPTION

While this invention may be embodied in many different forms, there are described in detail herein specific examples of the invention. This description is an exemplification of the principles of the invention and is not intended to limit the invention to the particular examples illustrated.

As indicated above known culvert "flap" style gate assemblies are often cumbersome and difficult to properly attach to the end of a culvert pipe that has been exposed to real world conditions and abuse.

As shown in PRIOR ART FIGS. 1A-1E, a typical culvert gate assembly 10 must be first fitted on to a culvert pipe 11 having the diameter to which the engagement band 12 of the assembly 10 is pre-manufactured. In other words: a gate assembly for use on a culvert pipe having an outer diameter of 10 inches will have an engagement band with an inner diameter somewhat larger than 10 inches, to allow the band to fit over the pipe). Because the pipe 11 may not be perfectly circular, may have been damaged, bent or otherwise distorted over time often the engagement band 12 will not fit over the pipe 11 for which the assembly 10 is designed. In such an instance it may be necessary to cut or otherwise repair the pipe 11 and/or modify the assembly 10 in order to achieve the necessary fit. This can be costly and time consuming, and may even require multiple attempts and modifications to accomplish the desired engagement.

Figure 1A:
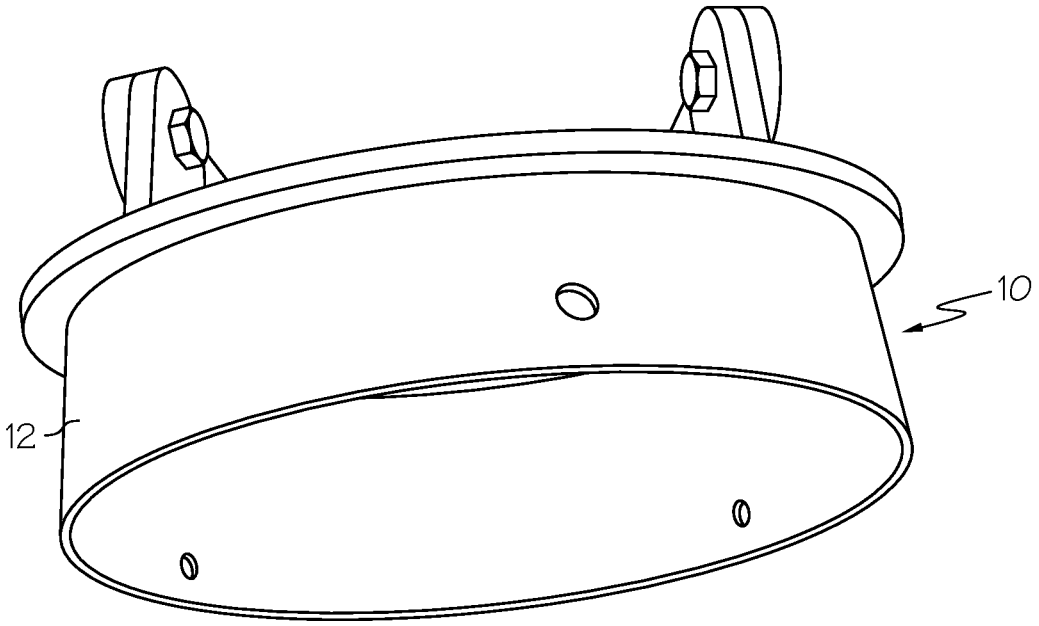
FIG. 1A (PRIOR ART)
FIGS. 1A-1E depict a PRIOR ART culvert gate assembly and a method of securing it to a culvert pipe.
Figure 1B:
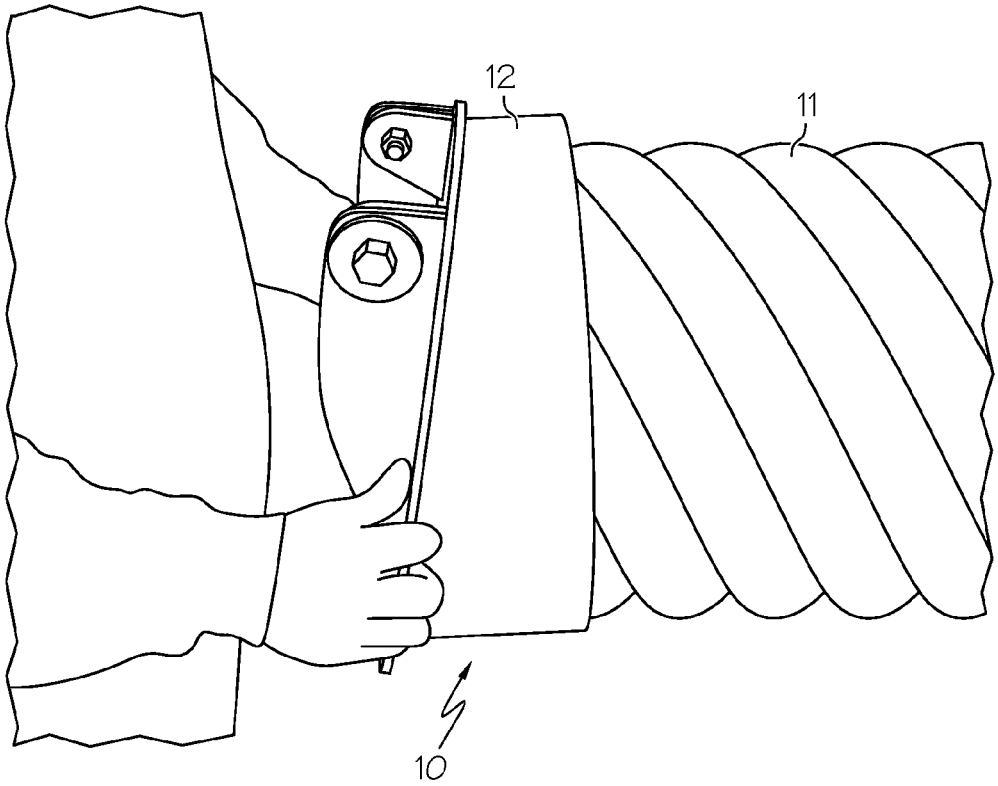
FIG. 1B (PRIOR ART)
Figure 1C:
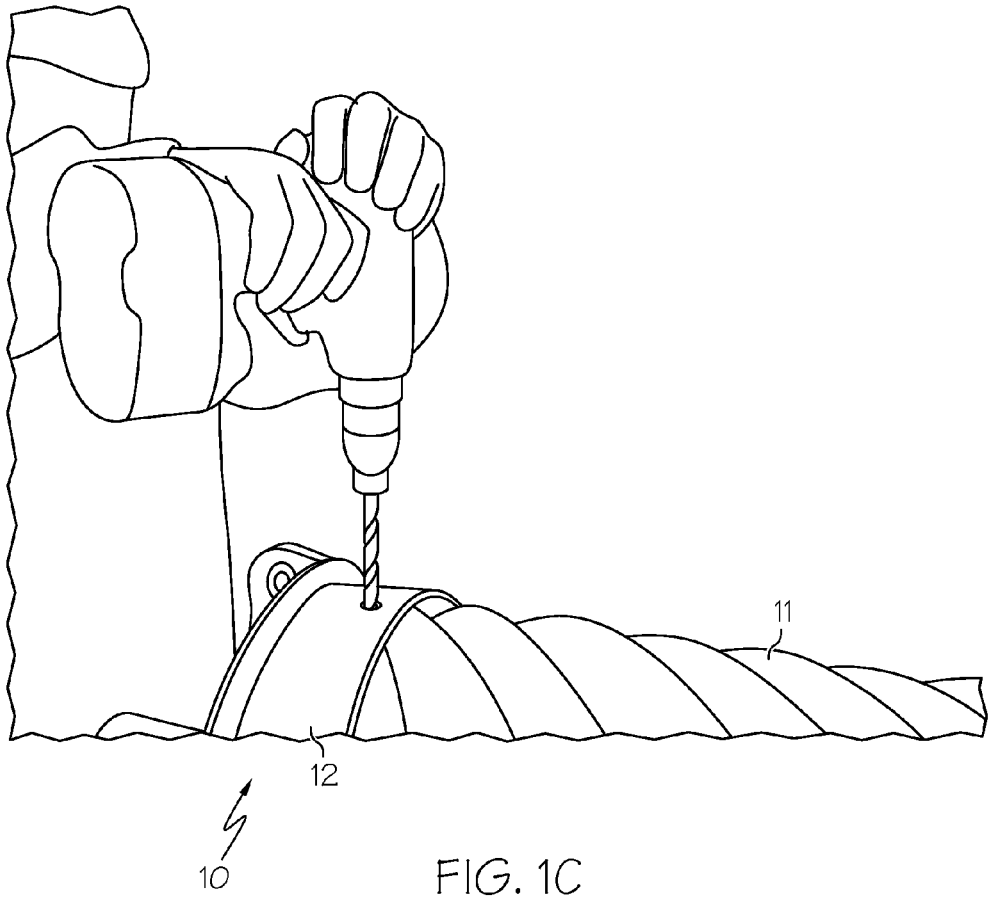
FIG. 1C (PRIOR ART)
Figure 1D:
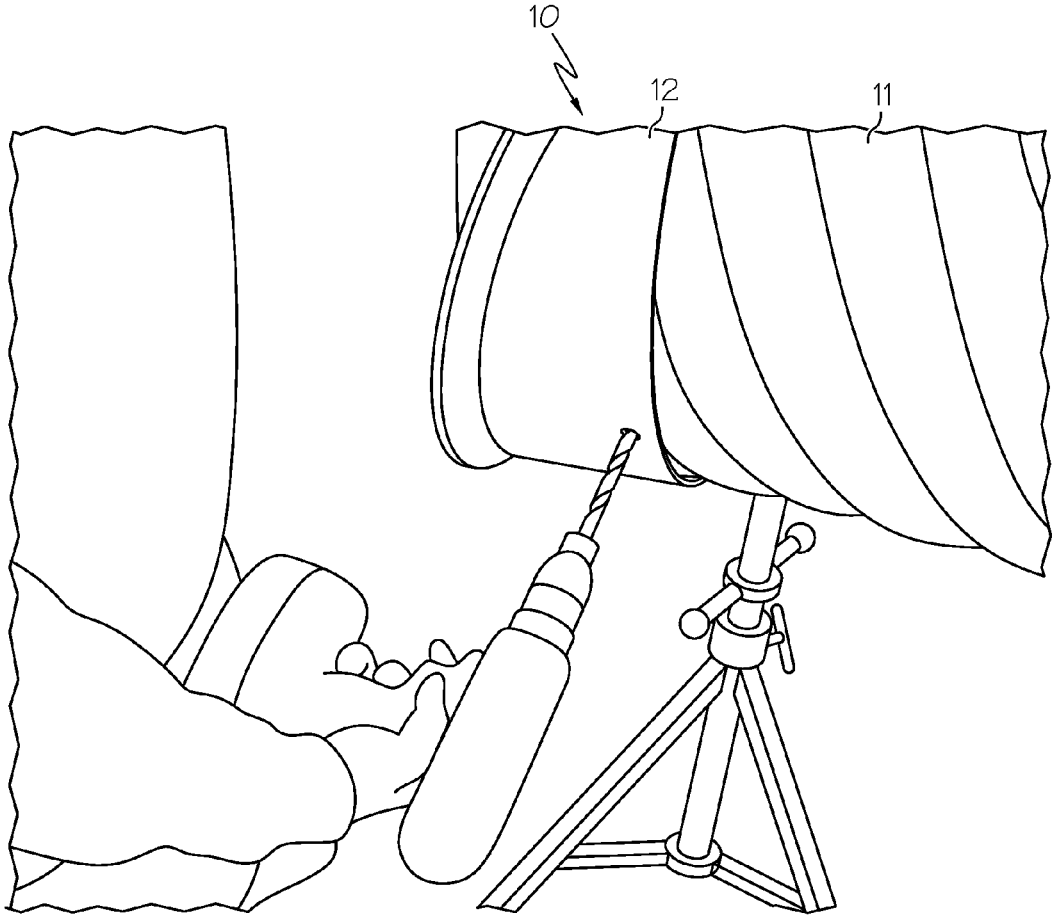
FIG. 1D (PRIOR ART)
Figure 1E:
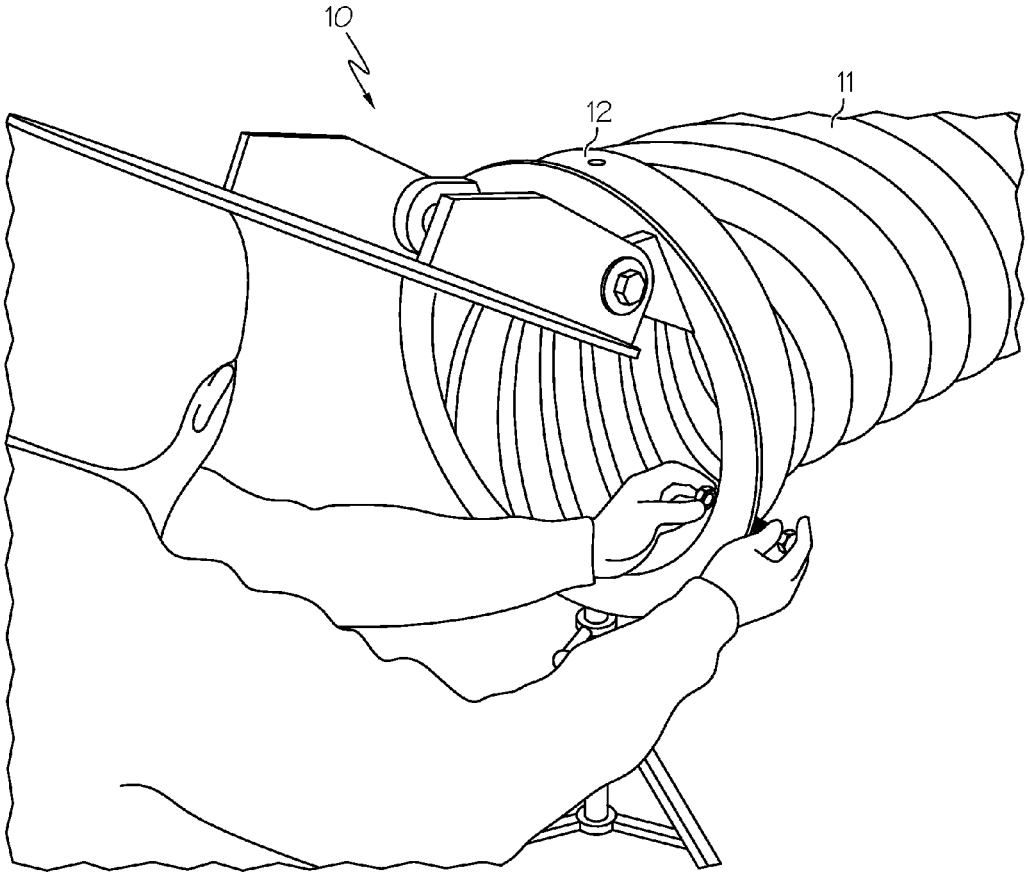
FIG. 1E (PRIOR ART)
Figure 2:
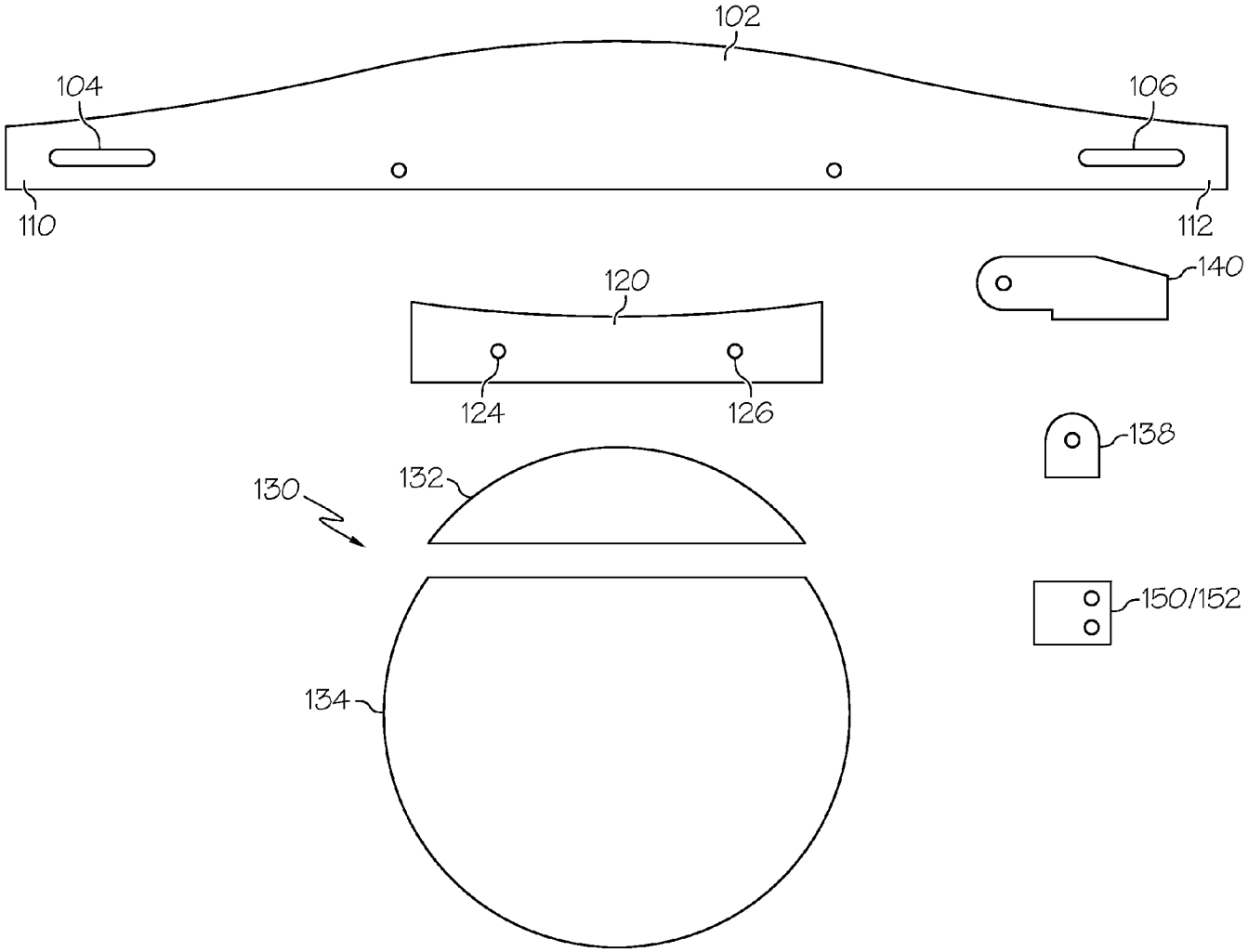
FIG. 2 is a schematic view of the components of an embodiment of a culvert gate assembly.

Even under ideal conditions such as in the PRIOR ART figures shown, it is often necessary to fully support the assembly 10 on the pipe 11 during attachment to ensure that the assembly 10 does not slide off (see PRIOR ART FIG. 1B). Once held in place onto the end of the pipe 11, a series of holes are drilled into the pipe 11 (holes are usually pre-positioned through the band 12) such as in the manner shown in PRIOR ART FIGS. 1C and 1D. During this procedure it is often necessary for one or more installers to securely hold the assembly 10 in place while another installer drills the requisite holes. Once the holes are properly drilled, securement bolts are passed through the corresponding holes of the pipe 11 and engagement collar 12, thus securing the gate assembly 10 into place.

To avoid the need for multiple installers, and to provide a gate assembly that can be more readily installed onto pipes having a wider range of sizing errors or imperfect shapes, the gate assembly of the present disclosure is provided with a "quick clamp" mechanism that allows the inner diameter of the engagement band to be adjustable and more user friendly than the PRIOR ART assembly design.

Turning to FIGS. 2-6, the gate assembly 100 includes an adjustable engagement band 102 which defines two adjustment slots 104 and 106 therethrough. As may be best seen in FIGS. 4-6 the engagement band 102 is formed into a ring shape, and is sized to define an opening 108 with a diameter sufficient to allow the band 102 to surround and engage a pipe (not shown) of a corresponding (though lesser) diameter in the manner discussed above. Underlying the region of the engagement band 102, where the ends 110 and 112 of the engagement band 102 are in closest proximity to one another, a band backer or collar support 120 is positioned. In some embodiments the collar support 120 defines two through holes 124 and 126 though which a bolt or stud 122 is passed. The position of holes 124 and 126 correspond and underlie respective slots 104 and 106. Each stud 122 passes through the corresponding hole and slot to secure the collar support 120 to the engagement band 102. In some embodiments studs 122 are integral with, welded thereto, or otherwise affixed to collar support 120 rather than passing through holes 124 and 126.

As is shown, the lid 130 includes two sections an upper portion 132 and lower portion 134. In some embodiments the upper portion 132 is welded or otherwise engaged to the collar support 120. In at least one embodiment the collar support 120 and upper portion 132 of the lid are machined as a single integral piece.

Figure 3:
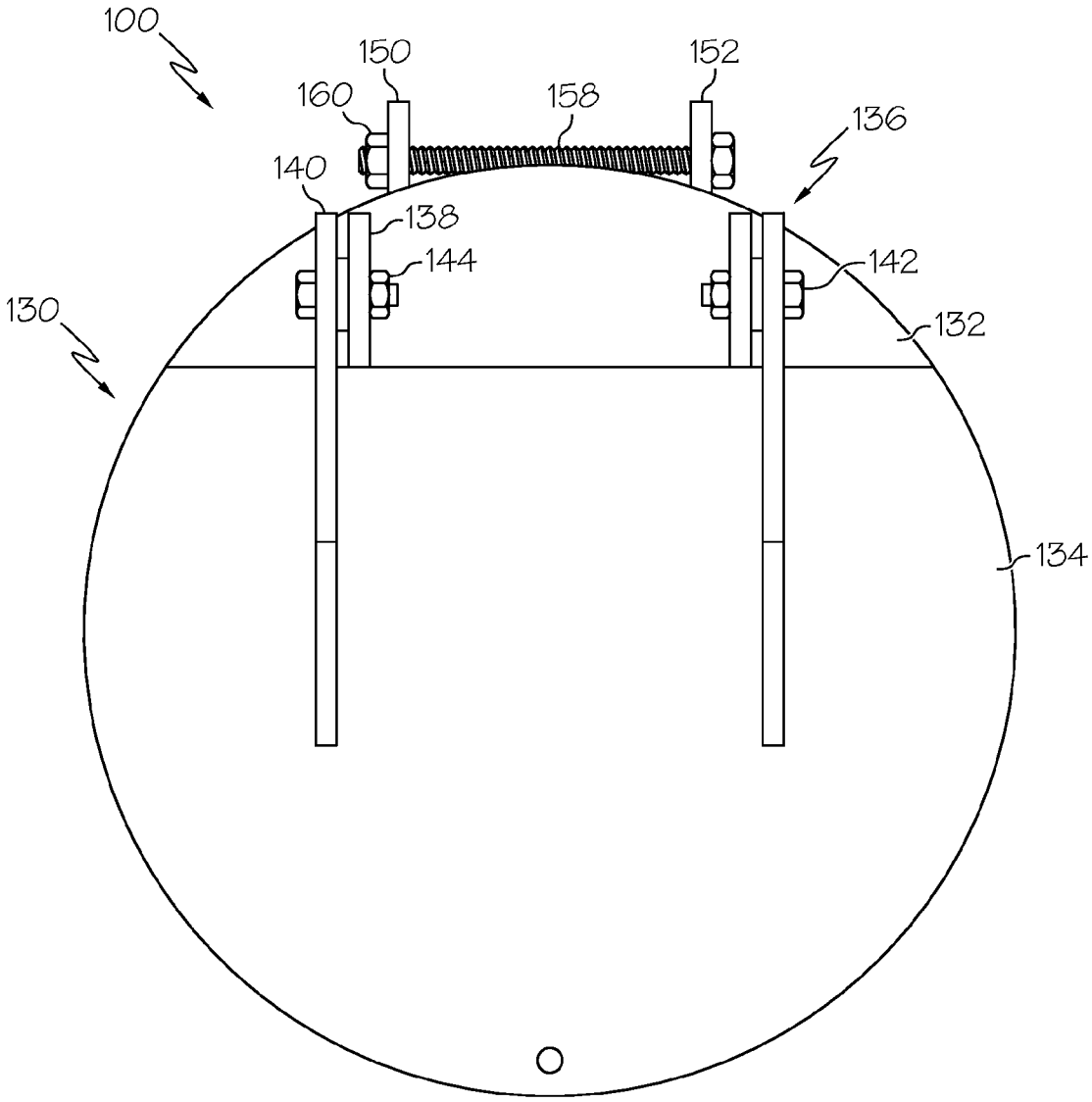
FIG. 3 is a front view of an embodiment of a culvert gate assembly.
Figure 4:
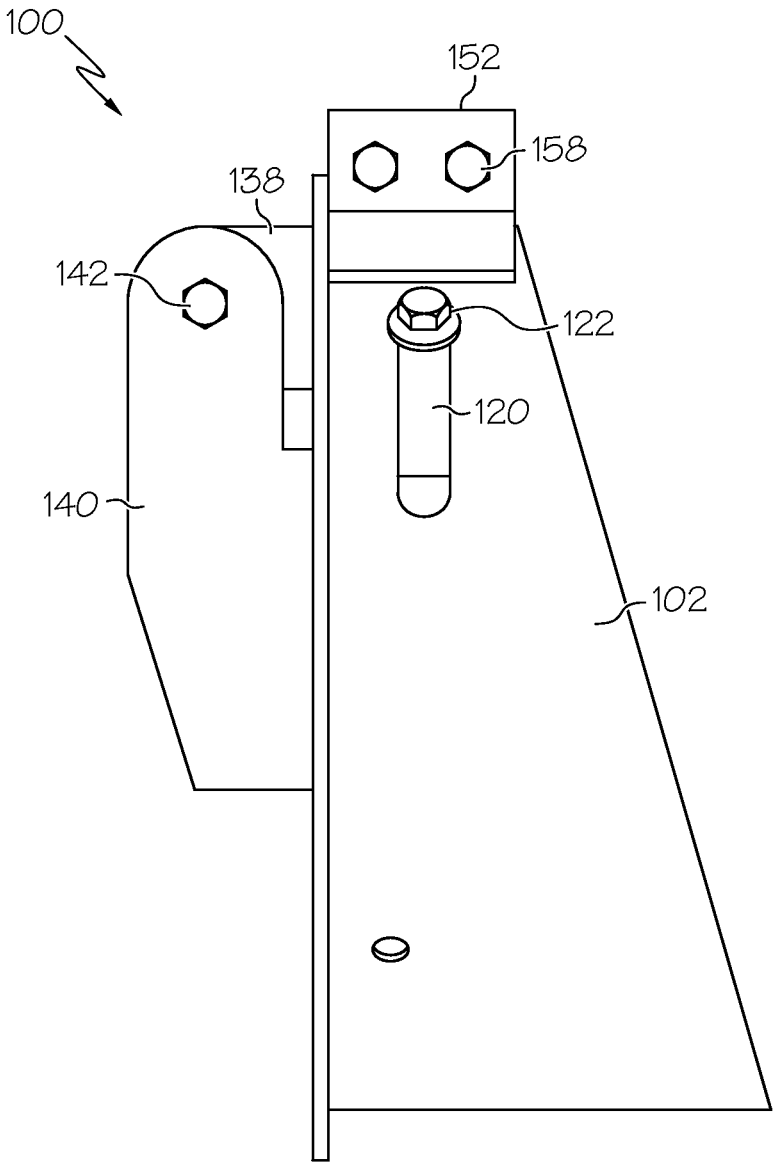
FIG. 4 is a side view of the embodiment shown in FIG. 3.
Figure 5:
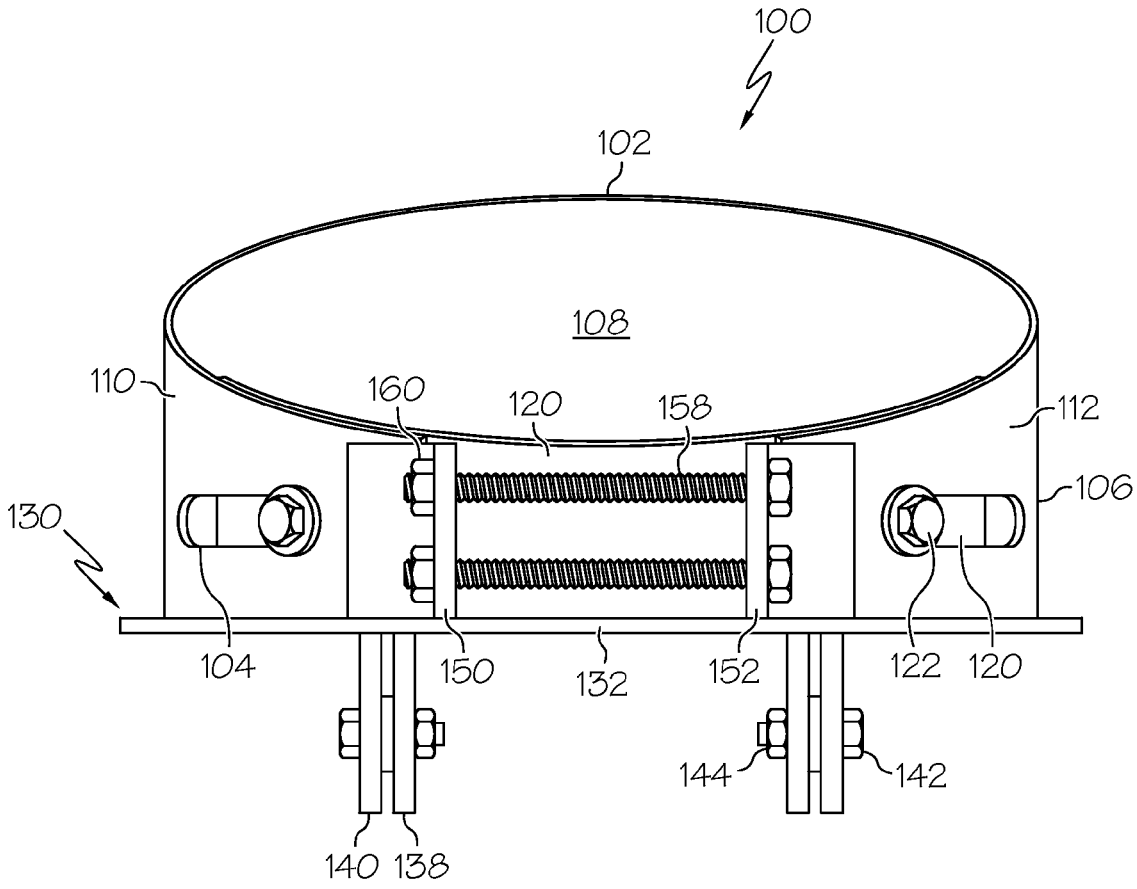
FIG. 5 is a top view of the embodiment shown in FIGS. 3-4.
Figure 6:
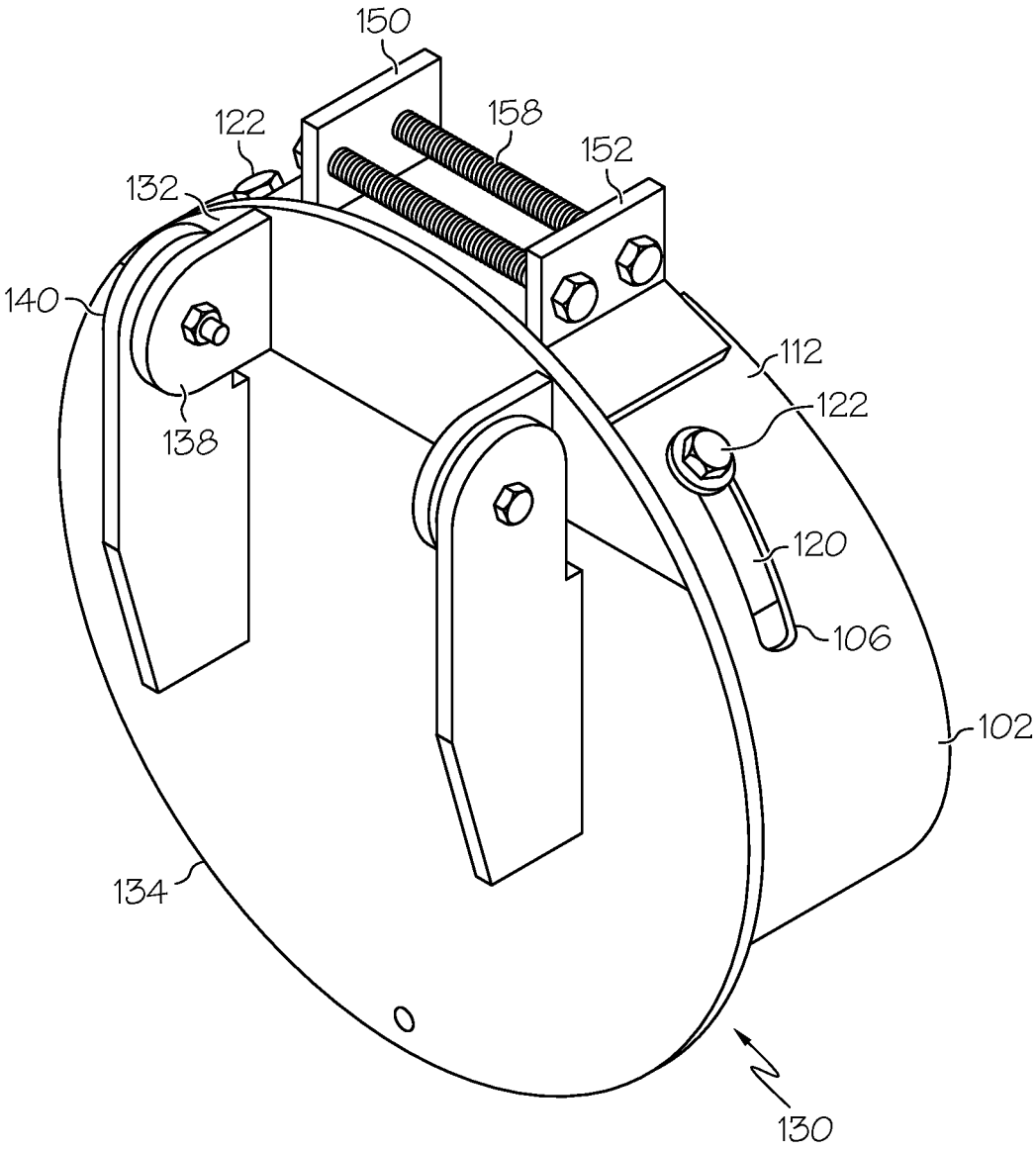
FIG. 6 is a perspective view of the embodiment shown in FIGS. 3-5.

As may be best seen in FIG. 3, the lower portion 134 of lid 130 is pivotally engaged to the upper portion 132 by hinge assemblies 136. Hinge assemblies 136 can be any type of hinge or pivotal engagement mechanism. In the embodiment shown, the hinge assemblies comprise inner and outer flanges 138 and 140, respectively. Each flange defines a through hole, through which a bolt 142 is passed (and secured by a nut 144) to allow the desired pivotal engagement of the lower portion 134 of the lid 130 to the upper portion 132.

The quick clamp feature mentioned previously is made up of two "L-shaped" flanges 150 and 152 respectively. Each flange is integral with, welded thereto, or otherwise engaged to an end of the engagement band 102 such as in the manner shown in FIGS. 4 and 5 (flange 150 engaged to end 110 and flange 152 engaged to end 112 of the engagement band 102).

As shown, each flange 150 and 152 defines a pair of openings 154 and 156 through which adjustment fasteners such as bolts 158 can be passed. Each bolt is secured at their end by a nut 160.

Figure 7A:
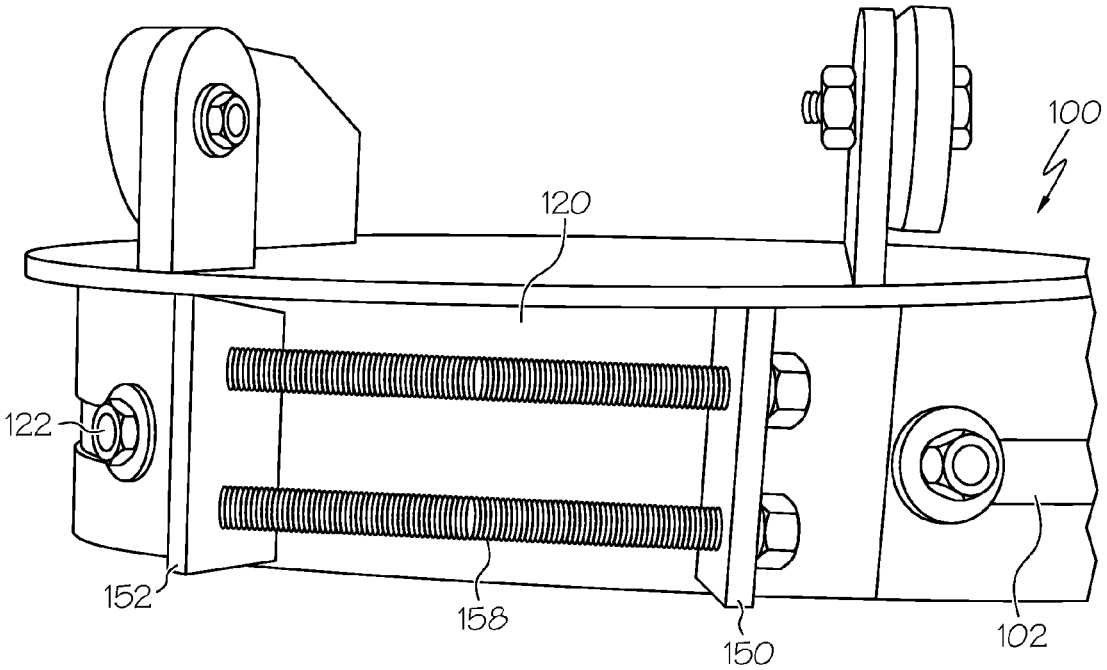
FIGS. 7A-7E depict the embodiment of the culvert gate assembly shown in FIGS. 2-6 as attached to an example culvert pipe.
Figure 7B:
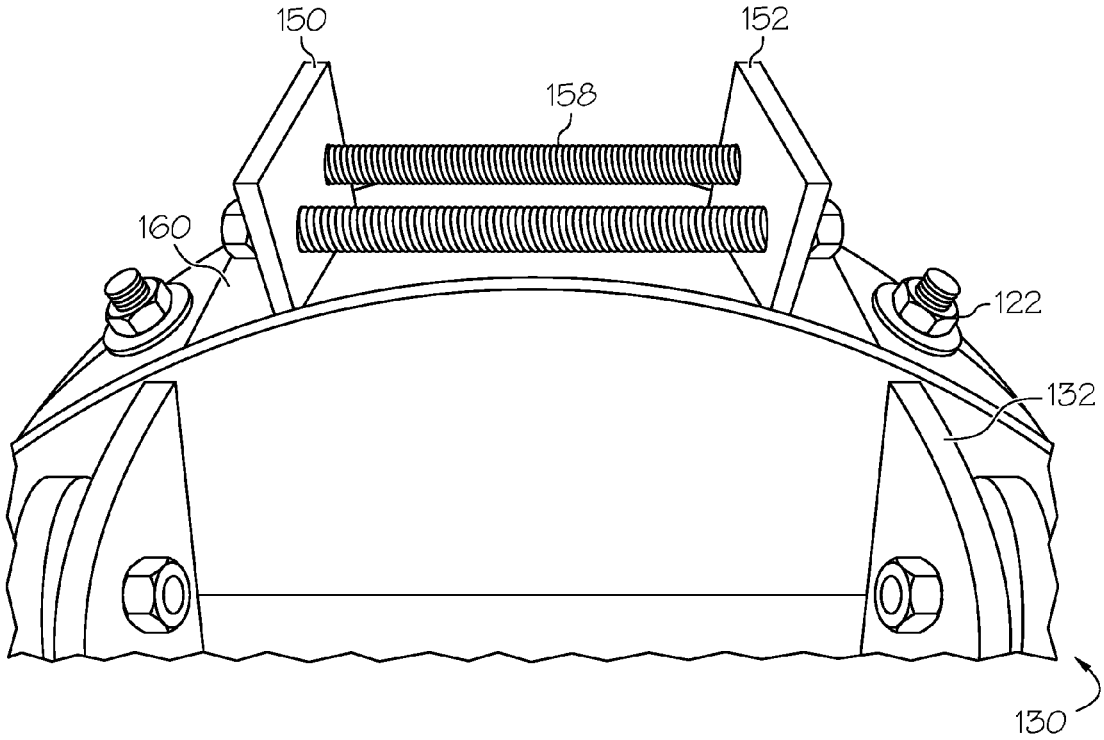
Figure 7C:
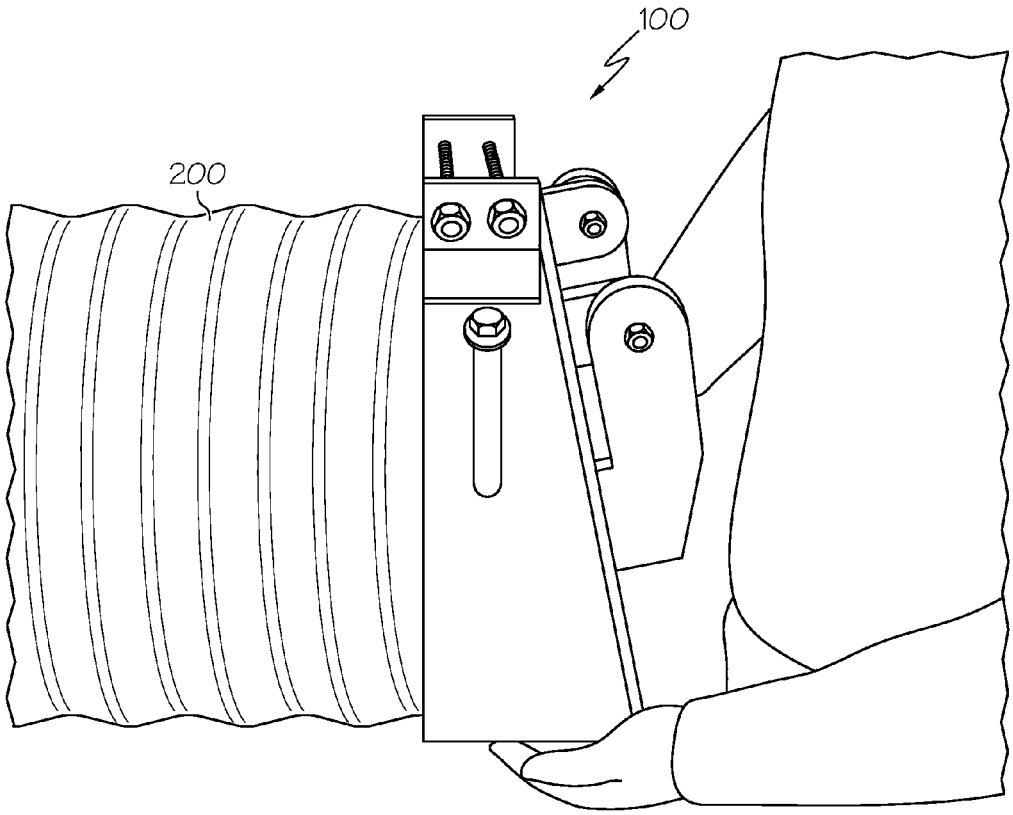
Figure 7D:
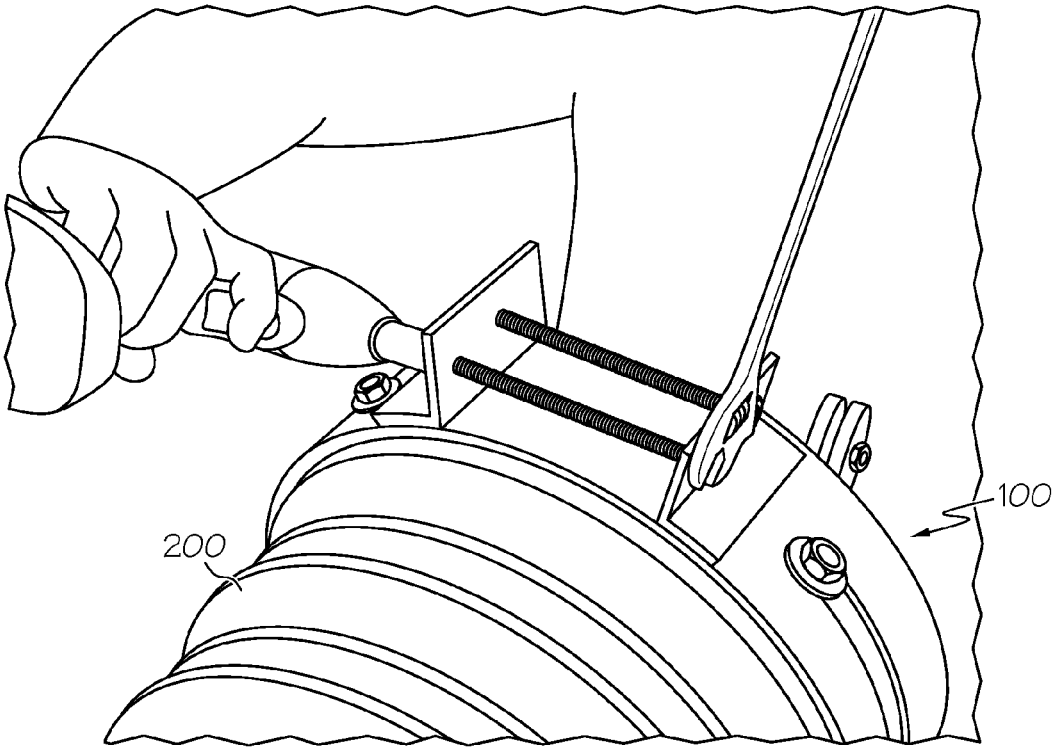
Figure 7E:
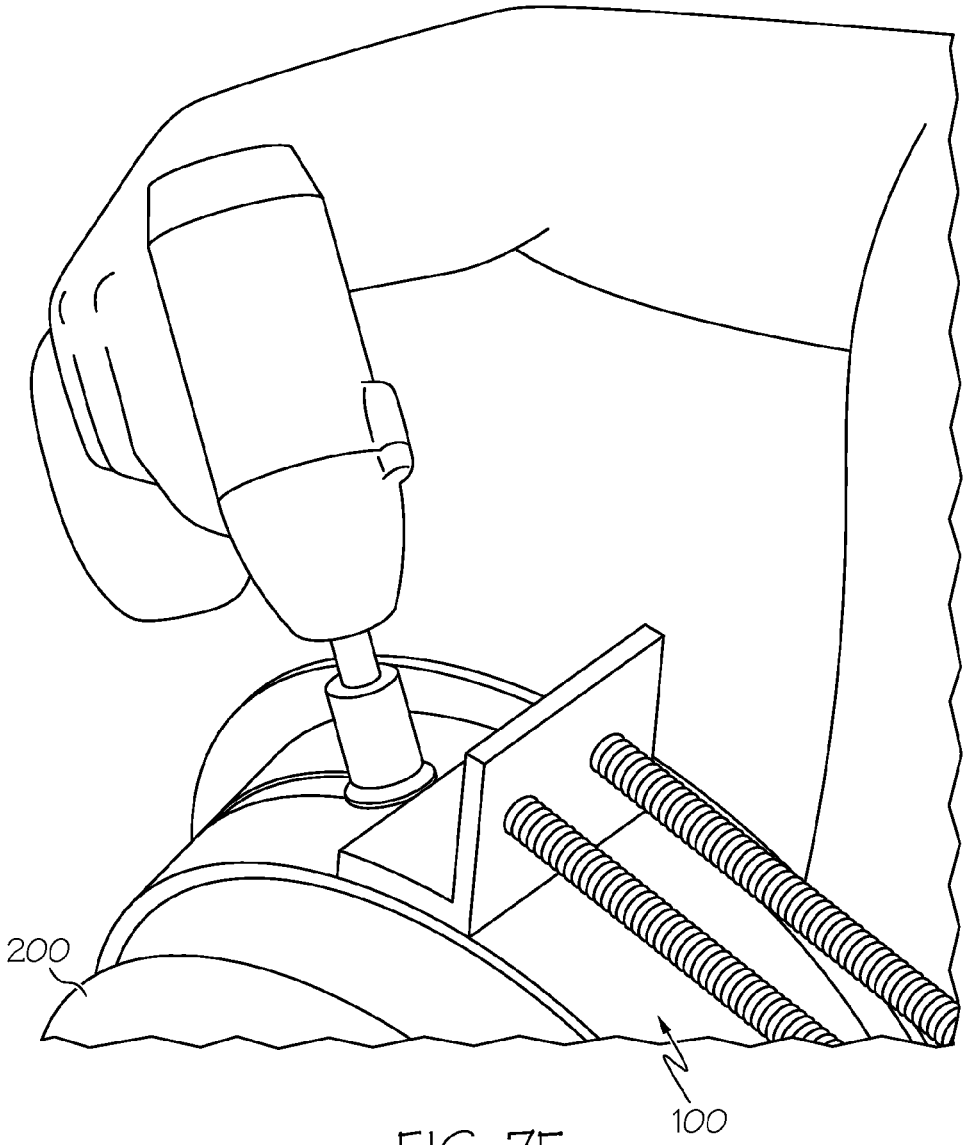

The quick clamp arrangement of the flanges 150 and 152 on the engagement collar 102 allows a single installer to position the gate assembly 100 over a pipe 200, such as in the manner shown in FIGS. 7C-7E. The quick clamp arrangement allows the opening 108 of the engagement band 102 to be adjustable and as such a single installer can more readily hold the assembly 100 in place while tightening or otherwise manipulating the bolts 158 and nuts 160 (see FIG. 7D) rather than having to first drill through the engagement band 102 such as in the manner described above.

The degree to which the diameter of opening 108 can be adjusted by the assembly described herein may be as great as approximately +/−30% of the predetermined nominal opening diameter. For example, in at least one embodiment the opening 108 is intended for a pipe 200 having a diameter of 18 inches, then by adjusting the nuts 160 and bolts 158 the opening 108 can be altered to be as small as about 12 inches or as large as about 24 inches. In at least one embodiment the opening 108 is variable between +/−20% the nominal opening diameter. In some embodiments the opening 108 is variable between +/−10% the nominal opening diameter.

Once the nuts 160 and bolts 158 are properly tightened the assembly 100 is adequately secured to the pipe 200. However by also tightening studs 122 of the collar support 120, such as in the manner shown in FIG. 7E, the collar support is further engaged to the pipe 200 providing additional securement of the upper portion 132 of the lid 130 to both the adjustment band 102 and the pipe 200.

In addition to the exemplary embodiment shown, one of ordinary skill in the art will understand that the present gate assembly 100 and its various components can be assembled in a variety of manners and in a variety of different sizes and configurations. Examples of such alternative embodiments are depicted in FIG. 8.

Figure 8:
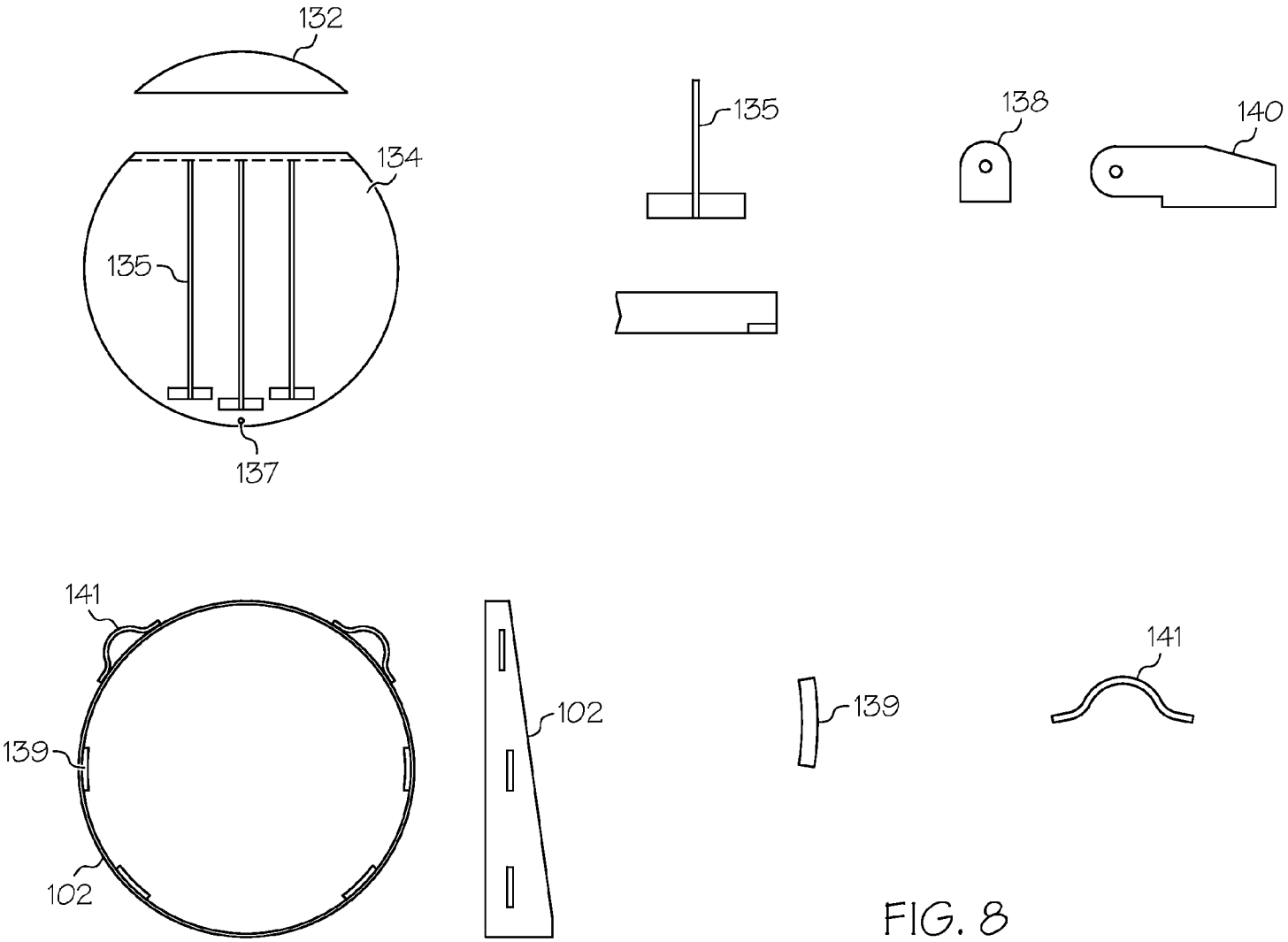
FIG. 8 is a schematic view of the components of an embodiment of the culvert gate assembly.

As shown in FIG. 8, in some embodiments lower portion 134 of lid 130 includes lid reinforcement bars 135. In at least one embodiment lower portion 134 of lid 130 defines an opening 137 through which a fastener may be passed, providing a means for securing, in a closed position, lower portion 134 of lid 130 to engagement band 102. In some embodiments engagement band 102 includes band reinforcement plates 139 fixed to the inner surface of engagement band 102. In at least one embodiment engagement band 102 includes hooks 141 fixed to the outer surface of engagement band 102.

The above disclosure is intended to be illustrative and not exhaustive. The description will suggest many variations and alternatives to those of ordinary skill in the art. All of these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. An adjustable gate assembly for engagement to a pipe, the assembly comprising:

an engagement band defining an adjustment slot at either end of the engagement band and an opening having a nominal diameter, the opening being adjustable by up to +/−30 percent of the nominal diameter;

a collar support defining at least two through holes and being constructed and arranged to reversibly attach to the engagement band;

a lid having an upper portion and a lower portion, the upper portion being fixed to the collar support, the lower portion being pivotally connected to the upper portion, the lid having an open position and a closed position, the lid being arranged to substantially cover the opening defined by the engagement band when the lid is in the closed position; and a plurality of fasteners;

wherein each adjustment slot is arranged to overlap at least one of the through holes of the collar support and at least one of the fasteners extends through each of the two through holes and each of the adjustment slots, the fasteners securing the collar support to the engagement band.

2. The adjustable gate assembly of claim 1 wherein the nominal diameter of the engagement band is greater than about 9 inches.

3. The adjustable gate assembly of claim 2 wherein the nominal diameter of the engagement band is within the range of about 9 inches to 50 inches.

4. The adjustable gate assembly of claim 1 further comprising a plurality of band reinforcement plates affixed to an inner surface of the engagement band.

5. The adjustable gate assembly of claim 1 further comprising:

a first flange attached to a first end of the engagement band; and a second flange attached to a second end of the engagement band;

at least one fastener engaging the first and second flanges, the fastener holding the first and second flanges substantially fixed relative to one another.

6. The adjustable gate assembly of claim 5 wherein the first and second flanges each define a hole, the at least one fastener engaging the first and second flanges comprising a bolt extending through the hole of the first flange and the hole of the second flange, the bolt being engaged and secured by a nut.

7. The adjustable gate assembly of claim 1 wherein the lid is arranged to open in only one direction.

8. The adjustable gate assembly of claim 1 further comprising a plurality of lid reinforcement bars attached thereto.

9. The adjustable gate assembly of claim 1 further comprising a plurality of hooks, each hook being attached to an outer surface of engagement band.

10. The adjustable gate assembly of claim 1 wherein the lid further comprises a hinge connecting the upper portion to the lower portion.

11. The adjustable gate assembly of claim 10, wherein the upper portion of the lid is welded to the collar support.

12. A culvert lid comprising:

a collar support, the collar support defining at least two through holes;

an engagement band having two opposing ends and first and second flanges attached to the opposing ends, the engagement band defining an adjustment slot at each end of the engagement band, each adjustment slot arranged to overlap at least one of the through holes of the collar support, the engagement band defining an opening having a nominal diameter, the opening being adjustable by up to +/−30 percent of the nominal diameter;

a plurality of fasteners, one of the fasteners extending through each of the two through holes of the collar support and an adjustment slot of the engagement band;

at least one fastener engaging the first and second flanges of the engagement band and holding the first and second flanges substantially fixed relative to one another;

a lid, the lid having an upper portion and a lower portion, the upper portion being attached to the collar support, wherein the lid has a closed position and is constructed to substantially cover the opening of the engagement band when the lid is in the closed position; and a hinge pivotally connecting the upper portion of the lid to the lower portion of the lid.

13. A culvert gate kit comprising:

a collar support defining at least two through holes;

an engagement band having two opposing ends and first and second flanges attached to the opposing ends, the engagement band defining an adjustment slot at each end of the engagement band, each adjustment slot arranged to overlap at least one of the through holes of the collar support, wherein the engagement band defines an opening, the opening having a nominal diameter, the opening being adjustable by up to +/−30 percent of the nominal diameter;

a plurality of fasteners, one of the fasteners configured to extend through each of the two through holes of the collar support and an adjustment slot of the engagement band;

at least one fastener constructed to engage the first and second flanges of the engagement band and hold the flanges in a substantially constant position relative to one another;

a lid, the lid having an upper portion and a lower portion, the upper portion being attached to the collar support, wherein the lid has a closed position and is constructed to substantially cover the opening of the engagement band when the lid is in the closed position; and a hinge configured to pivotally connect the upper portion of the lid to the lower portion of the lid.

* * * * *